US005353041A

United States Patent [19]

Miyamoto et al.

[11] Patent Number: 5,353,041

[45] Date of Patent: Oct. 4, 1994

[54] DRIVING DEVICE AND DISPLAY SYSTEM

[75] Inventors: Katsuhiro Miyamoto, Hiratsuka; Hiroshi Inoue, Yokohama, both of Japan

[73] Assignee: Canon Kabushiki Kaisha, Tokyo, Japan

[21] Appl. No.: 787,739

[22] Filed: Nov. 4, 1991

Related U.S. Application Data

[63] Continuation of Ser. No. 440,321, Nov. 22, 1989, abandoned.

[30] Foreign Application Priority Data

Aug. 31, 1989 [JP] Japan ..... 1-225380

[51] Int. Cl.[5] ..... G09G 3/36

[52] U.S. Cl. ..... 345/97; 345/100

[58] Field of Search ..... 340/784, 805, 719; 345/94, 97, 98, 99, 100; 359/56

[56] References Cited

U.S. PATENT DOCUMENTS

| | | | |
|---|---|---|---|
| 3,716,658 | 2/1973 | Rackman | 340/784 |
| 4,638,309 | 1/1987 | Ott | 340/752 |
| 4,638,310 | 1/1987 | Ayliffe . | |
| 4,655,561 | 4/1987 | Kanbe et al. . | |
| 4,693,563 | 9/1987 | Harada et al. | 350/350 |
| 4,701,026 | 10/1987 | Yazaki et al. . | |
| 4,709,995 | 12/1987 | Kuribayashi et al. | 350/350 |
| 4,711,531 | 12/1987 | Masubuchi . | |
| 4,715,688 | 12/1987 | Harada et al. . | |
| 4,725,129 | 2/1988 | Kondo et al. . | |
| 4,770,502 | 9/1988 | Kitazima et al. . | |
| 4,839,638 | 6/1989 | Kosler et al. | 340/784 |
| 4,901,066 | 2/1990 | Kobayashi et al. | 340/784 |
| 4,908,613 | 3/1990 | Green | 340/719 |
| 4,908,710 | 3/1990 | Wakai et al. | 358/236 |
| 4,938,574 | 7/1990 | Kaneko et al. | 345/97 |
| 5,047,757 | 9/1991 | Bone et al. | 340/784 |
| 5,092,665 | 3/1992 | Kanbe et al. | 345/97 |
| 5,093,737 | 3/1992 | Kanbe et al. | 340/784 |
| 5,132,818 | 7/1992 | Mouri et al. | 340/784 |

FOREIGN PATENT DOCUMENTS

| | | |
|---|---|---|
| 256879 | 2/1988 | European Pat. Off. . |
| 0308987 | 3/1989 | European Pat. Off. . |
| 60-172029 | 9/1985 | Japan . |

*Primary Examiner*—Richard Hjerpe
*Assistant Examiner*—Steven J. Saras
*Attorney, Agent, or Firm*—Fitzpatrick, Cella, Harper & Scinto

[57] ABSTRACT

A display system includes a display panel provided with matrix electrodes composed of scanning lines and information lines, a first unit for transferring scanning line address information and image information corresponding to the writing into pixels of a scanning line, a second unit for delaying the transfer of the received image information and then latching the image information of a scanning line, and a third unit for designating a scanning line based on the received scanning line address information and storing the designation information of the designated scanning line. A fourth unit controls the second and third units so as to, when third unit designates a scanning line based on the received scanning line address information, synchronize the selective drive of the scanning line designated by the immediately preceding stored information for designating the scanning line with the drive of the information lines based on the image information latched by the second means, and selectively drives the scanning line designated according to the scanning line address information within the period of the synchronization.

28 Claims, 10 Drawing Sheets

FIG. 2A HSYNC
FIG. 2B AH/DL
FIG. 2C DRIVE START SIGNAL
FIG. 2D INPUT INFORMATION (PD0-7)
FIG. 2E SHIFT REGISTER INPUT
FIG. 2F LINE MEMORY OUTPUT
FIG. 2G DECODER
FIG. 2H MEMORY
La Ld Ma Md Na Nd Oa Od Pa Pd Qa Qd
Kd (c) Ld Md Nd Od Pd
(b) Kd Ld Md Nd Od Pd
La Ma Na Oa Pa Qa
Ka La Ma Na Oa Pa
T1 T2 T3

FIG. 4A CLK
FIG. 4B CLK TWO FREQ DIVIDE
FIG. 4C PD0-7
FIG. 4D AH/DL OR PROCESSOR TRIGGER
FIG. 4E ADDRESS VALUE
FIG. 4F R/W
FIG. 4G ID0-7
FIG. 4H DELAY ENABLE
La0-7
La8-11
Ld0-7
Ld8-11
Ld2552-2559
0
1
319
Ld0-7
Ld8-11
Ld2552-2559

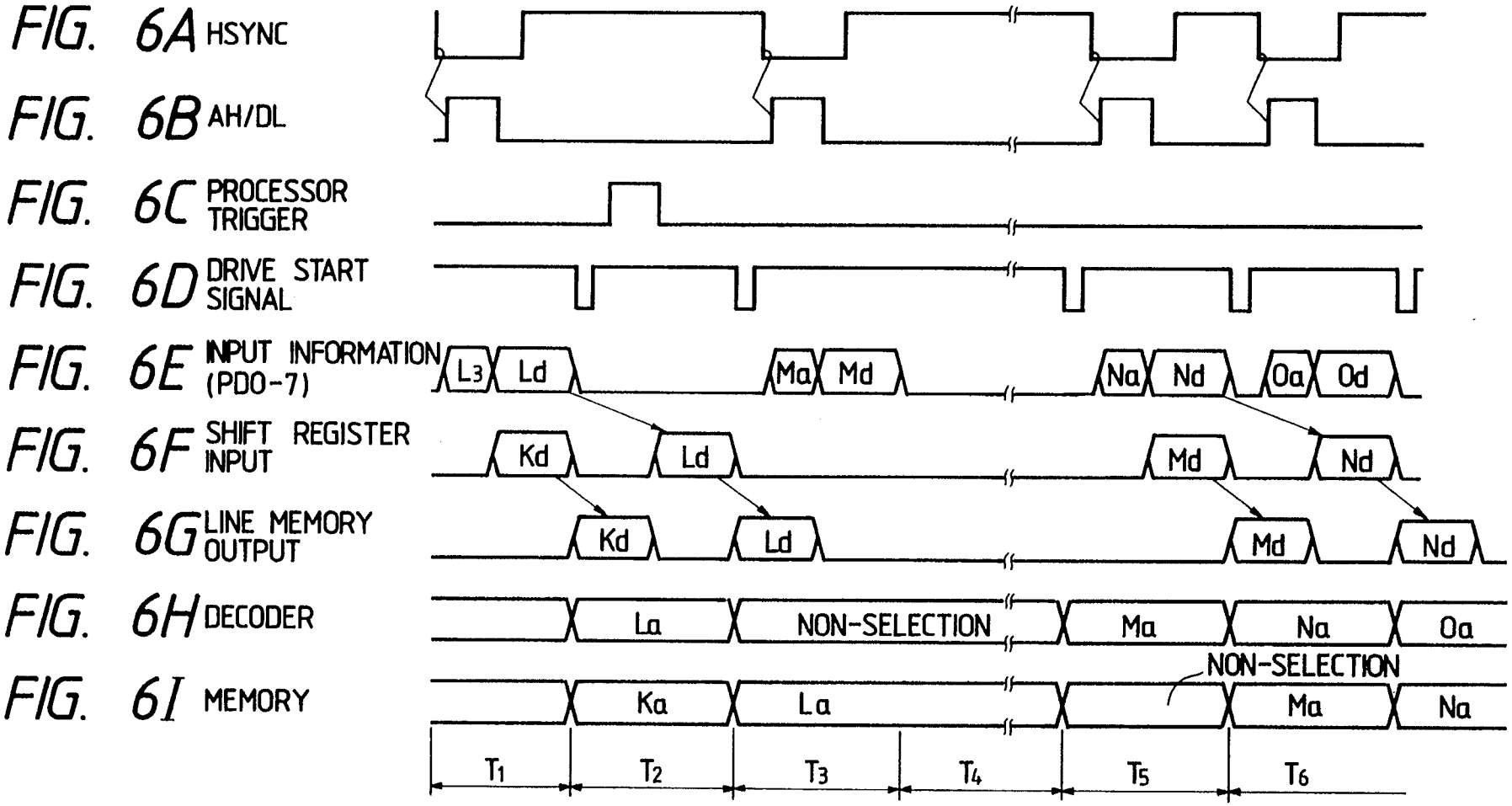
FIG. 6A HSYNC
FIG. 6B AH/DL
FIG. 6C PROCESSOR TRIGGER
FIG. 6D DRIVE START SIGNAL
FIG. 6E INPUT INFORMATION (PD0-7)
FIG. 6F SHIFT REGISTER INPUT
FIG. 6G LINE MEMORY OUTPUT
FIG. 6H DECODER
FIG. 6I MEMORY
L3
Ld
Ma
Md
Na
Nd
Oa
Od
Kd
Ld
Md
Nd
Kd
Ld
Md
Nd
La
NON-SELECTION
Ma
Na
Oa
Ka
La
NON-SELECTION
Ma
Na
T1
T2
T3
T4
T5
T6

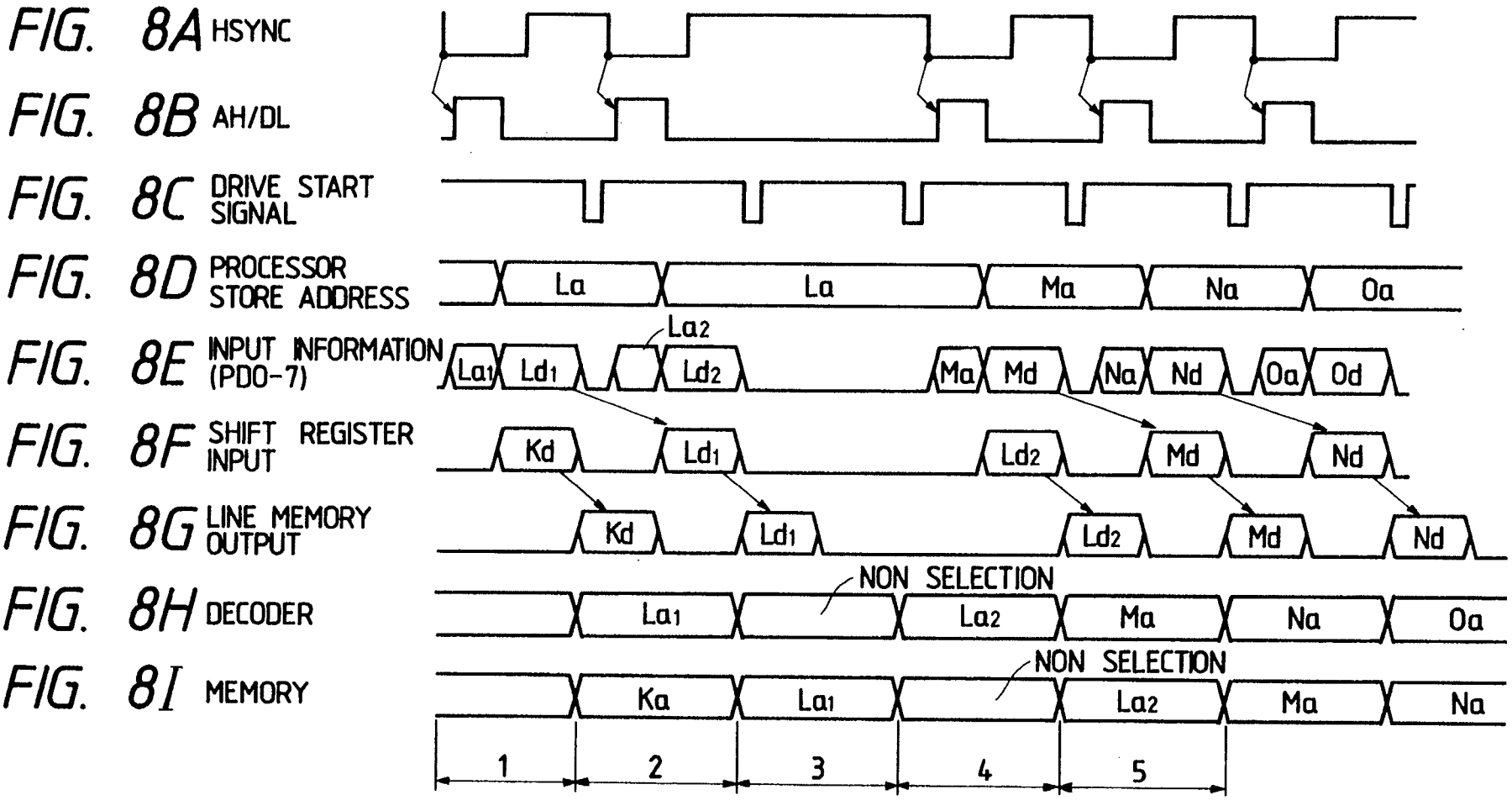
FIG. 8A HSYNC
FIG. 8B AH/DL
FIG. 8C DRIVE START SIGNAL
FIG. 8D PROCESSOR STORE ADDRESS
FIG. 8E INPUT INFORMATION (PD0-7)
FIG. 8F SHIFT REGISTER INPUT
FIG. 8G LINE MEMORY OUTPUT
FIG. 8H DECODER
FIG. 8I MEMORY
La
Ma
Na
Oa
La1
Ld1
La2
Ld2
Ma
Md
Na
Nd
Oa
Od
Kd
Ld1
Ld2
Md
Nd
La1
La2
Ma
Na
Oa
Ka
La1
La2
Ma
Na
NON SELECTION
NON SELECTION
1
2
3
4
5

SCAN SELECTION SIGNAL

SCAN NON-SELECTION SIGNAL

INFORMATION SIGNAL (D)

INFORMATION SIGNAL (BLACK)

DRIVING DEVICE AND DISPLAY SYSTEM

This application is a continuation of application Ser. No. 07/440,321 filed Nov. 22, 1989, now abandoned.

BACKGROUND OF THE INVENTION

1. Field of the Invention

The present invention relates to a driving device for a display device equipped with a matrix electrode structure, and in particular to a driving device for a ferroelectric liquid crystal display device and a display system utilizing the same.

2. Related Background Art

The ferroelectric liquid crystal display devices are driven by multiplexing drive methods as already proposed in U.S. Pat. No. 4,655,561 of Kanbe et al., U.S. Pat. No. 4,638,310 of Arpliffe, U.S. Pat. No. 4,715,688 of Harada et al., U.S. Pat. No. 4,701,026 of Yazaki et al., U.S. Pat. No. 4,725,129 of Kondo et al., and U.S. Pat. No. 4,711,531 of Masubuchi et al.

In these drive methods, a voltage signal of a pulse duration and a peak value sufficient for generating a black or white display state in a pixel of a scanning line is applied within a period selected for scanning. Such voltage signals are applied in succession for each scanning line, and an image frame is formed by repeating such signal supply. Consequently, the above-mentioned driving methods have been associated with a drawback that the frame frequency becomes inevitably lower with the increase in the number of scanning lines.

The above-mentioned drawback has been solved by driving methods proposed in the Japanese Laid-open Patent Sho 60-172029 of Kanbe et al., and the U.S. Pat. No. 4,770,502 of Kitajima et al. In these driving methods, after the pixels of a scanning line are simultaneously erased to the black (or white) display state, signal writing to said pixels is conducted by the application of a writing voltage signal, and at the same time the pixels of a scanning line to be written next are simultaneously erased. These methods allow to increase the frame frequency.

In such methods, the selected periods for two scanning lines mutually overlap in such a manner that, while a scanning line is subjected to a writing operation, the next scanning line is subjected to an erasing operation. Consequently, if there is an interruption display (for example frame display drive, which is a scanning at regular intervals for forming a frame display) or a change in the display conditions due to a temperature change in the course of display drive, such interruption display or change of driving conditions is initiated after a scanning operation so that the scanning line to be selected next remains in the erased state.

SUMMARY OF THE INVENTION

An object of the present invention is to provide a driving device not associated with the above-mentioned drawbacks.

Another object of the present invention is to provide a driving device capable of providing a high frame frequency and enabling smooth transition to an interruption display drive.

The present invention is firstly featured by a driving device comprising:

A. matrix electrodes composed of scanning lines and information lines;

B. an information line driving circuit comprising:

b1: a delay circuit for delaying the transfer of image information corresponding to the pixels on the scanning line;

b2: a serial-parallel conversion circuit; and b3: a first memory for storing image information from said serial-parallel conversion circuit;

C. a scanning line driving circuit comprising:

c1: a scanning line designating circuit for designating scanning lines; and c2: a second memory for storing designated scanning line information from the scanning line designating circuit; and D. control means for controlling the information line driving circuit and the scanning line driving circuit in such a manner as to synchronize the output of image information stored in the first memory, output of the designated scanning line information from the scanning line designating circuit and output, from the second memory, of the information designating the scanning line corresponding to the image information stored in the first memory, erase the pixels on the scanning line designated according to the designated scanning line information from the scanning line designating circuit, and apply the writing voltage signals to the pixels on the scanning line designated according to the information from the second memory during said erasing drive period.

The present invention is secondly featured by a display system comprising:

A. A display panel equipped with matrix electrodes composed of scanning lines and information lines;

B. first means for transferring scanning line address information and image information corresponding to the writing into pixels on a scanning line;

C. second means for delaying the transfer of received image information and then latching image information of a scanning line;

D. third means for designating a scanning line based on the received scanning line address information, and storing the information of thus designated scanning line; and E. fourth means for controlling the second means and the third means in such a manner, when the third means designates a scanning line based on the received scanning line address information, as to synchronize the selective drive of a scanning line designated by the stored, information immediately preceding scanning line designating information with the drive of information lines based on the image information latched by the second means, and to selectively drive the scanning line designated by said scanning line address information in said synchronized period.

BRIEF DESCRIPTION OF THE DRAWINGS

FIGS. 6A to 6I are timing charts in an interruption display drive;

FIGS. 8A to 8I are timing charts when one-line partial rewriting is conducted consecutively;

DETAILED DESCRIPTION OF THE PREFERRED EMBODIMENTS

Now the present invention will be clarified in detail by embodiments thereof shown in the attached drawings.

Figure 1:
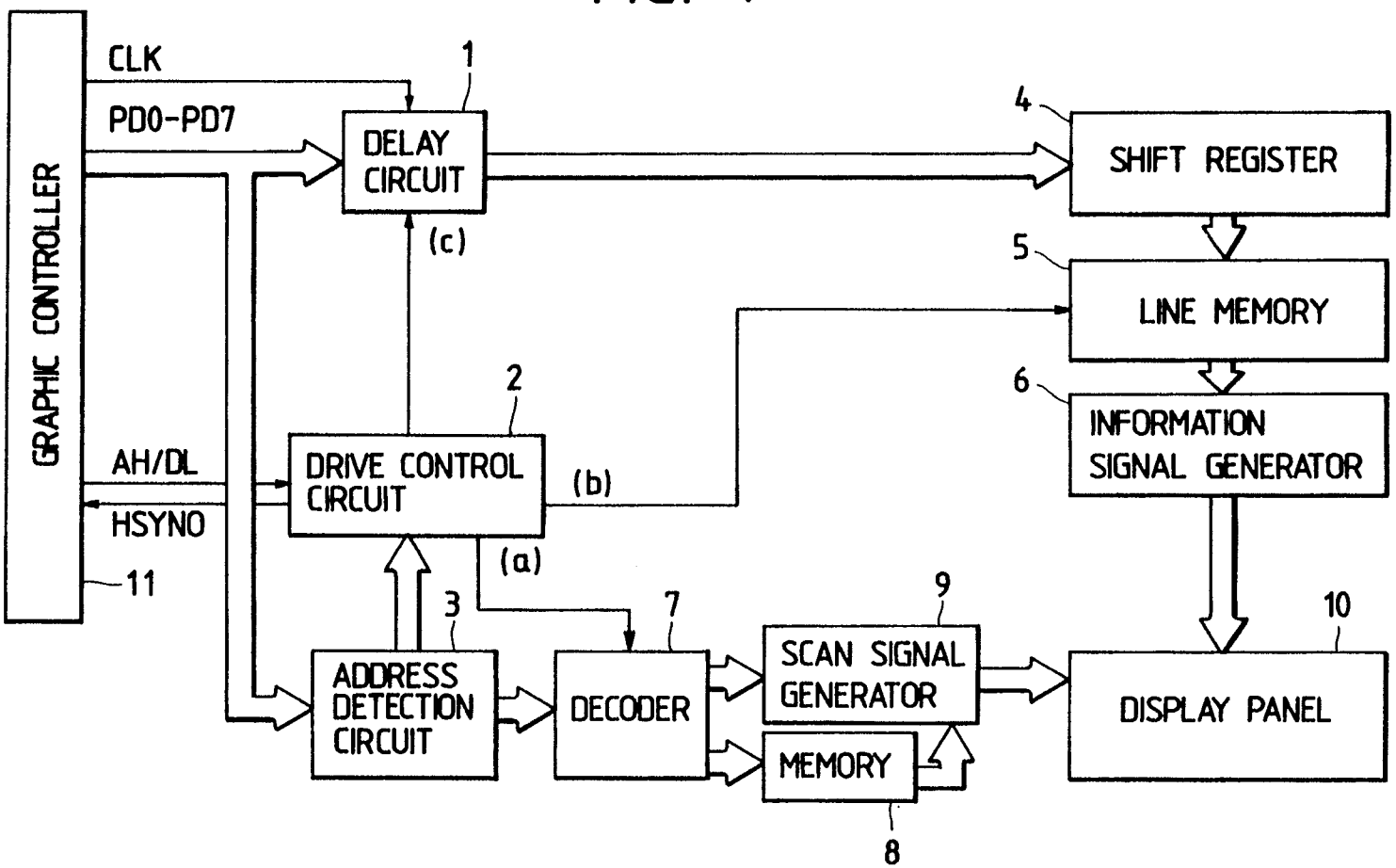
FIG. 1 is a block diagram of the driving device of the present invention.

FIG. 1 is a block diagram of the driving device of the present invention, wherein provided are a delay circuit 1 for delaying the transfer of image information corresponding to the writing into the pixels on the scanning line; a drive control circuit 2 composed of a one-chip microcomputer; an address detection circuit 3 for detecting address information, for designating the scanning line, from the information from an internal graphic controller 11; a shift register 4 for serial-parallel conversion of the image information; a line memory 5 for storing image information corresponding to the writing into the pixels of a scanning line; and information signal generating circuit 6 for generating drives voltages based on the image information; a decoder 7 for decoding the scanning line address information detected by the address detection circuit 3 thereby designating the scanning to be selected; a memory 8 for storing the designated scanning line information from the decoder 7; a scanning signal generating circuit 9 for generating driving voltages for driving the scanning line designated by the designated scanning line information from the decoder 7 and the memory 8; and a display panel 10 equipped with matrix electrodes composed of scanning lines and information lines and ferroelectric liquid crystal.

Figure 2:
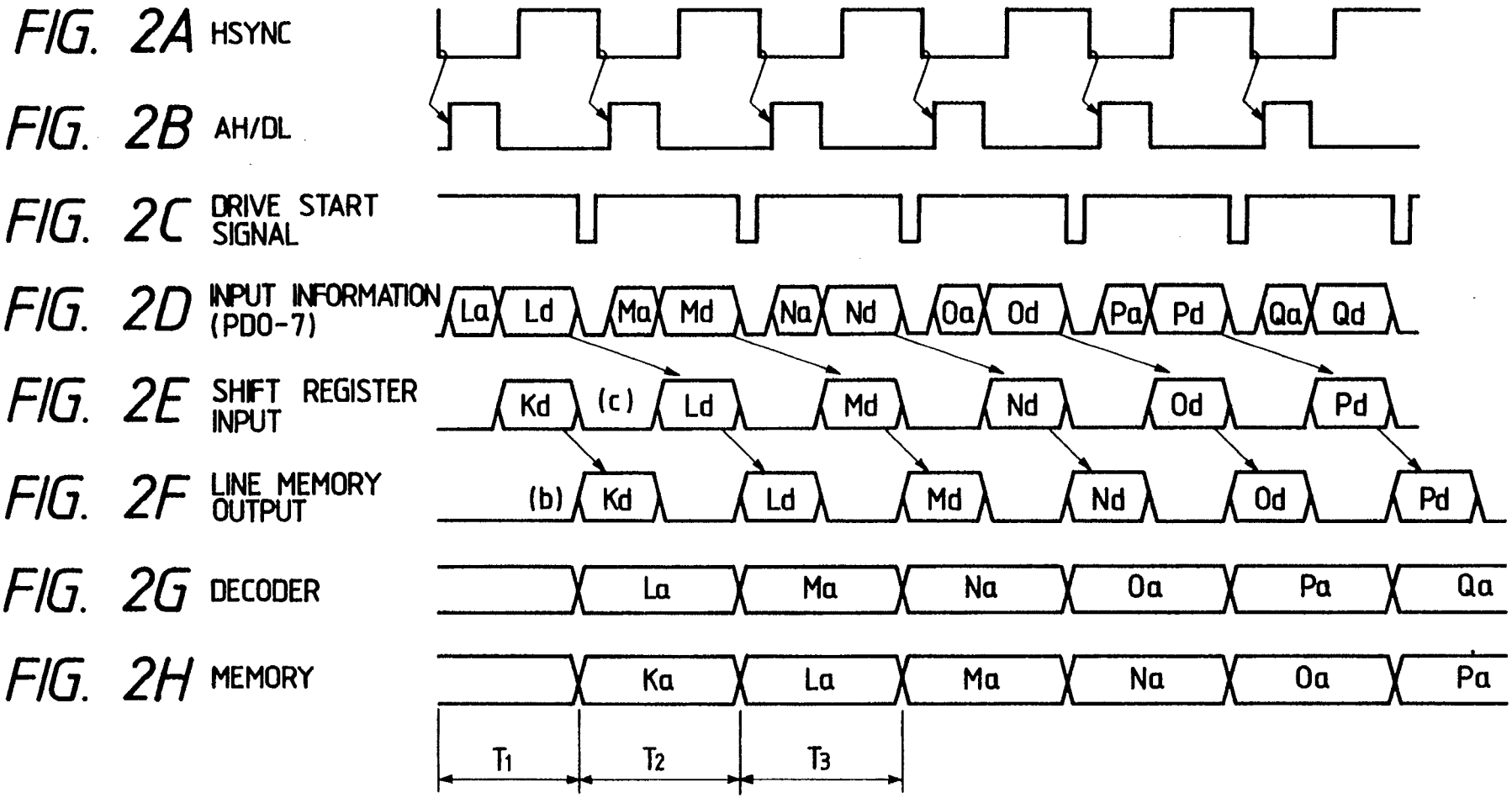
FIGS. 2A to 2H are timing charts of a normal display operation.

FIG. 2 is a timing chart of the driving operation. In the following there will be explained the function in the normal drive with reference to FIGS. 1 and 2.

The device of the present invention receives the image information and the scanning line address information from the graphic controller 11, by the handshake method. The microcomputer in the drive control circuit 2 indicates to the graphic controller 11 that reception of data is possible, by shifting a signal HSYNC to the L-level. Upon detecting the downshift of said signal, the graphic controller 11 transfer signals AH/DL and PD0–PD7 (image information and scanning line address information) in synchronization with a clock signal CLK. Since the image information and the scanning line address information are transmitted through the same transmission channel, the AH/DL signal is used as the identification signal therefor. More specifically, the PD0–PD7 signal represents the scanning line address information or the image information respectively when said AH/DL signal is at the H- or L-level.

Figure 3:
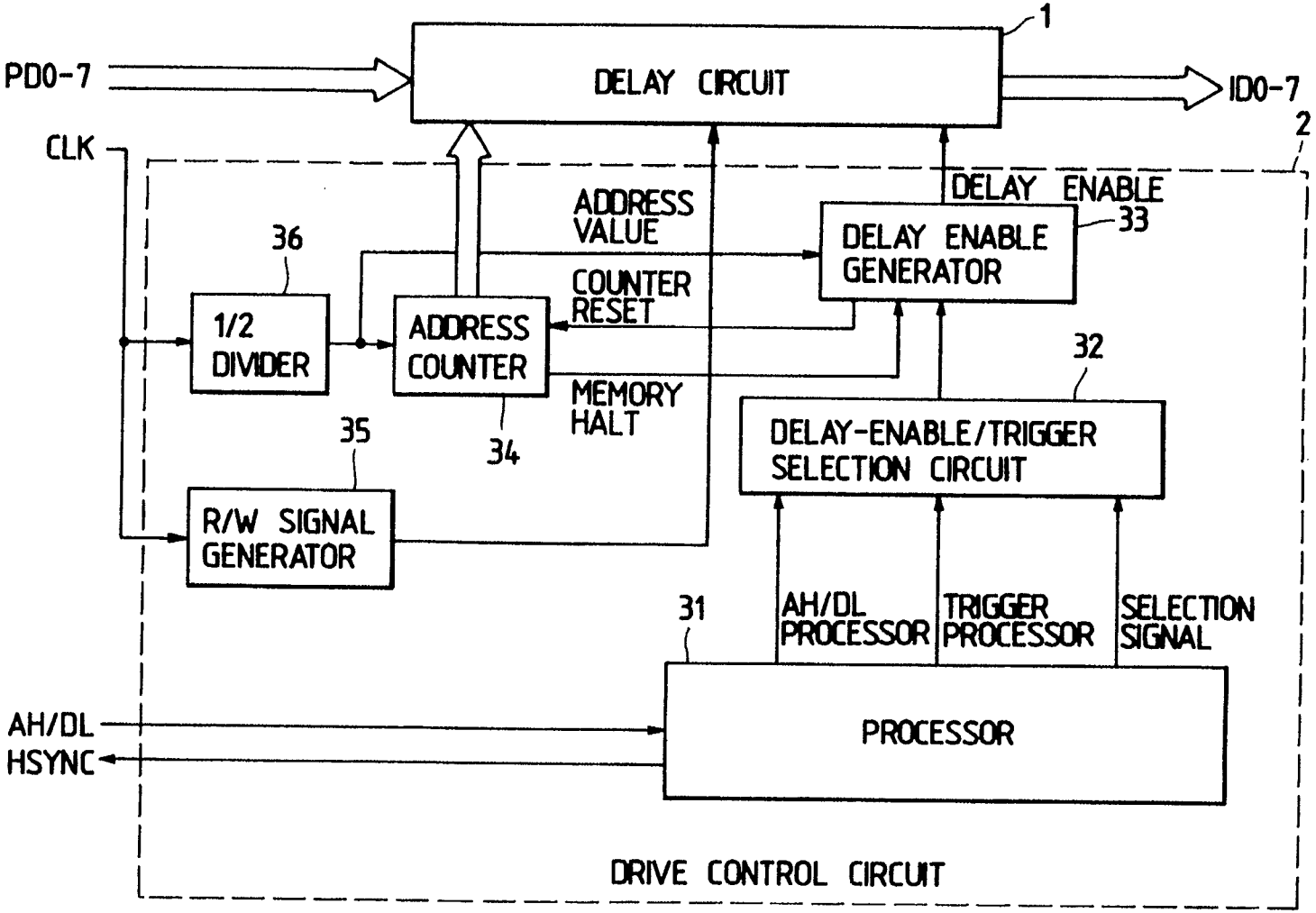
FIG. 3 is a detailed block diagram of a drive control circuit employed in the driving device of the present invention.
Figure 4:
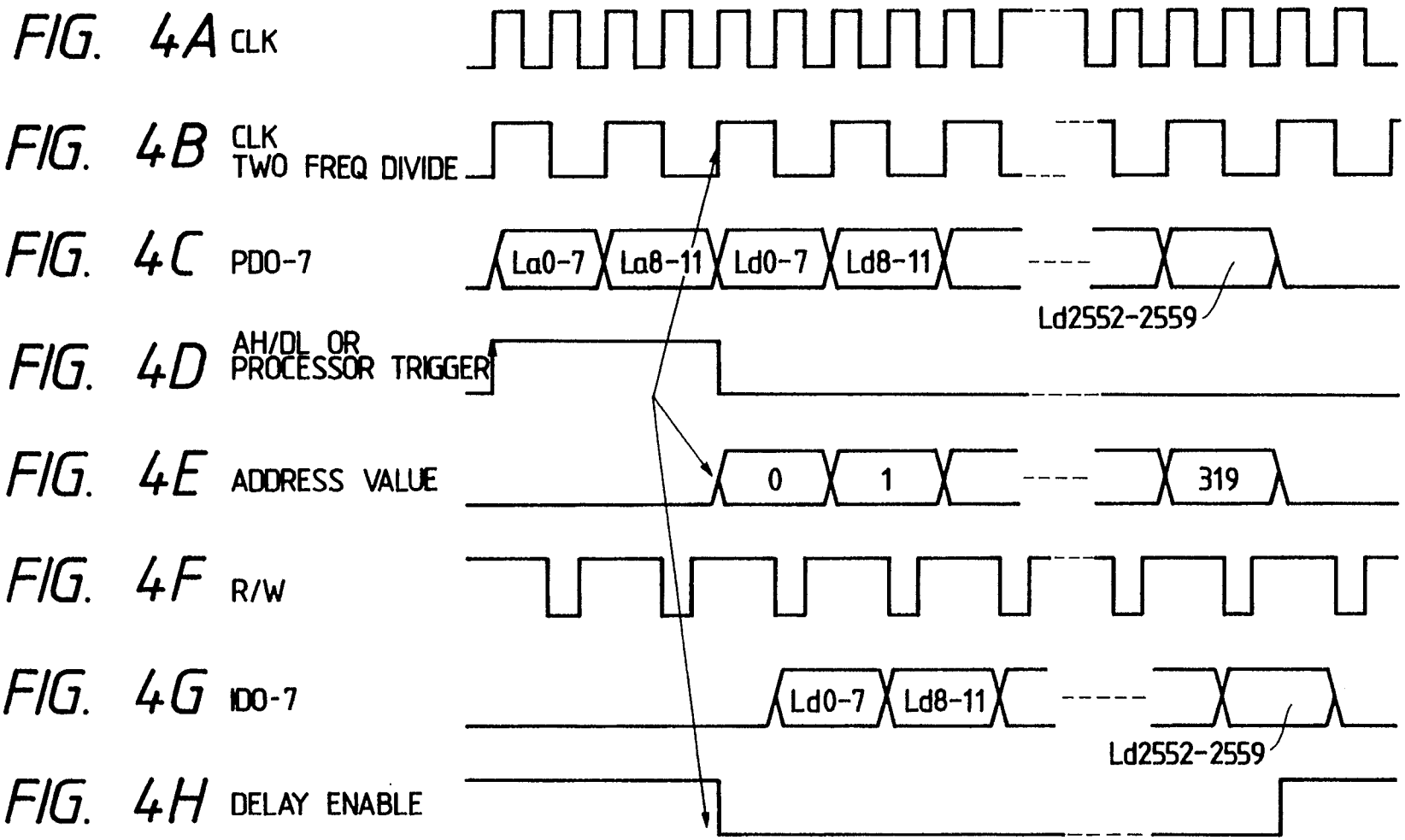
FIGS. 4A to 4H are timing charts thereof.

FIG. 3 is a detailed block diagram of the drive control circuit 2 shown in FIG. 1, and FIG. 4 is a timing chart thereof. A microcomputer 31 serves to transfer the HSYNC signal to the graphic controller 11, receives the AH/DL signal, and controls the transmission of the AH/DL signal, a microcomputer trigger signal and a selection signal to a delay enable/trigger selection circuit 32. There are also provided a delay enable generating circuit 33, an address counter 34, a R/W signal generator 35, and a ½ frequency divider 36.

The microcomputer 31 can select either the AH/DL signal or the microcomputer trigger signal for effecting the delay enable triggering. The selected signal is supplied to the delay enable generator 33, and said signal and a clock signal obtained by ½ frequency division of the clock signal CLK from the graphic controller to generate a delay enable signal which is supplied to the delay circuit. At the same time the address counter 34 is reset to renew the data in the memory. When the rewriting of the memory proceeds to a predetermined address, the address counter 34 sends a memory stop signal to the delay enable generator 33, whereby the memory enable signal is shifted to the H-level to terminate the function of the delay circuit 1.

The circuit 2 enables the rewriting of the delay circuit without the information transfer from the graphic controller 11.

In the normal drive, the selection signal supplied from the microcomputer 31 of the drive control circuit 2 to the delay enable/trigger selection circuit 32 is such that the AH/DL signal is used as the delay enable trigger signal. In a period T1 shown in FIG. 2, the microcomputer 31 maintains the HSYNC signal at the L-level, whereby the image information Ld (Ld0–7, Ld8–11 . . . , Ld2552–2559) from the graphic controller 11 is transferred to the delay circuit 1 in synchronization with the clock signal CLK. At the same time the input information PD0–7 is supplied to the address detection circuit 3 for detecting the scanning address information (La0–7, La8–11, Ma0–7 . . . ).

Thus the microcomputer 31 releases a drive start signal (line (b) in FIG. 1), thus latching the content of the shift register 4 in the line memory 5. Simultaneously the scanning line address information La is transferred from the address detection circuit to the decoder 7 and decoded therein to designate a line to be erased. Said period T1 corresponding to a horizontal scanning period 1H, or the time for rewriting a line. In a period T2, the drive is started by a drive start signal released from the microcomputer 31. In this state, the scanning line to be erased is designated by the decoder 7 (scanning line L in this example), and the pixels to be written in the scanning line (scanning line K in this example) are those set in the memory 8.

Said lines L and K are simultaneously driven by the scanning signal generator 9.

Figure 5:
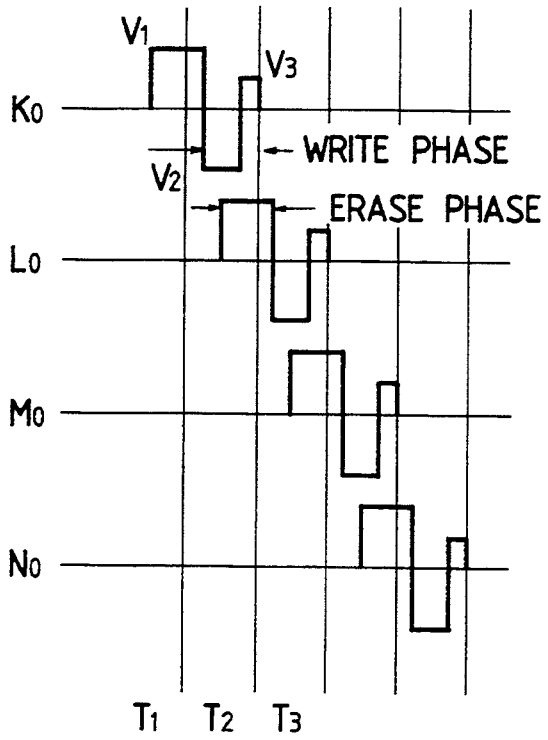
FIG. 5 is a wave form chart of scanning signal in the normal display operation.

The driving voltage supplied to the scanning line L corresponds to an "erase phase" shown in FIG. 5, and that supplied to the line K corresponds to a "write phase" shown in FIG. 5. In FIG. 5 there are shown a selection signal with voltage levels V1, V2 and V3, and a non-selection signal with voltage 0.

Figure 10:
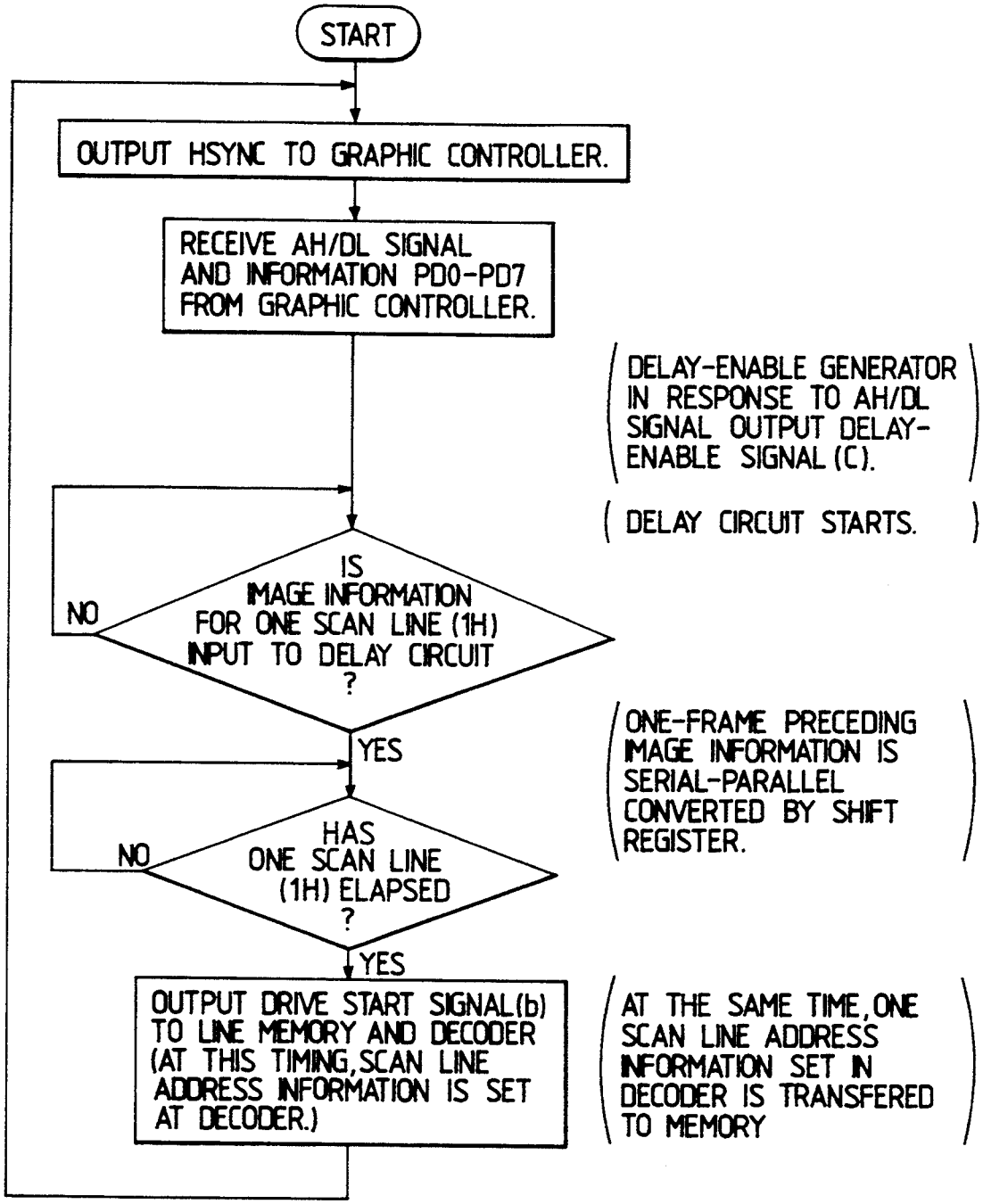
FIG. 10 is a flow chart of the microprocessor in the normal display operation.
Figure 11A:
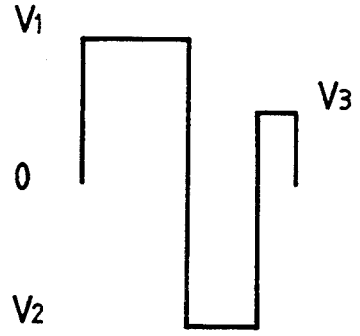
FIGS. 11A to 11D are wave form charts of the driving voltage employed in the present invention.
Figure 11B:
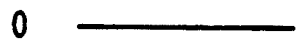
Figure 11C:
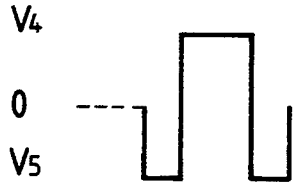
Figure 11D:
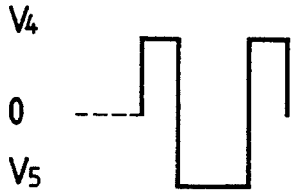

On the other hand, the microcomputer 31 shifts the HSYNC signal to the L-level, for receiving next information PD0–7 from the graphic controller 11. The image information Md is transferred to the delay circuit 1 as explained above, and the preceding image information Ld is transferred to the shift register 4. The address detection circuit 3 detects the scanning line address information Ma. Then the microcomputer 31 releases the drive start signal, thus latching the image information Ld of the shift register 4 in the line memory 5. At the same time, the scanning line address information Ma is transferred, in synchronization, to the decoder 7, and the designation of the scanning line L is set in the memory 8. Thus, in a period T3, the pixels on the scanning line M are erased, and the pixels on the scanning line L are rewritten into black or white according to the image information Ld stored in the line memory 5. Also, the microcomputer 31 shifts the HSYNC signal to the low level whereby the image information Nd is transferred to the delay circuit 1, and the image information Md is transferred to the shift register 4. The address detection circuit 3 detects the scanning line address information Na, and, in response to the drive start signal, the designation of the scanning line N is set in the decoder 7 while the designation of the scanning line M is set in the memory 8. The normal drive is thus conducted in succession according to the above-explained procedure. FIG. 10 is a flow chart showing the control sequence of the microcomputer 31 in the above-explained procedure. In the following there will be explained the procedure of an interruption drive, for modifying the drive wave form in the course of a drive, or for a partial rewriting.

Figure 7:
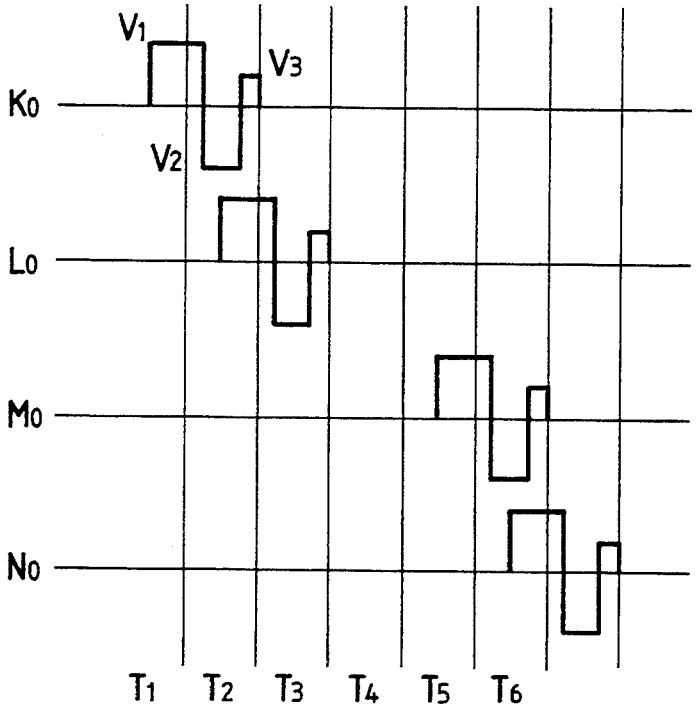
FIG. 7 is a wave form chart of scanning signal in said drive.

FIG. 6 is a timing chart of this drive. It is assumed that the microcomputer 31 detects, in a period T1, the necessity for temperature compensation or for a frame drive. More specifically, the microcomputer 31 is equipped with a counter for counting the number of scan designation, and constantly compares said number with the number of scan designations at which the temperature compensation or the frame drive has to be conducted. Thus the microcomputer 31 can recognize, at the reception of the information LD0–7, the necessity for temperature compensation or frame drive. The address detection circuit 3 detects the scanning line address information La, and the delay circuit 1 stores the image information Ld. Thereafter, in response to the drive start signal, the image information Kd is set in the line memory 5, the scanning line address information La is set in the decoder 7, and the designation information of the scanning line K, designated in the period T1, is set in the memory 8. In the period T2, the writing is conducted in the scanning line K while the scanning line L is erased. In the device of the present invention, in order to prohibit the information transfer from the graphic controller 11, the microcomputer 31 maintains the HSYNC signal at the H-level. Then the delay enable/-trigger selection circuit 32 of the drive control circuit 2 is switched from the AH/DL signal to the microcomputer trigger. In order to transfer, to the shift register 4, the image information Ld which remains stored in the delay circuit 1 because the scanning line L remains erased, the microcomputer 31 releases a delay enable trigger (microcomputer trigger) signal through a line (c) in FIG. 1. In response to said signal, the image information from the delay circuit 1 is transferred to the shift register 4 without reception of information from the graphic controller 11. The address detection circuit 3 does not detect the scanning line address information, and the microcomputer 11 releases a non-selection signal (line (a) in FIG. 1) indicating the absence of selection of all the scanning lines. Thus, in response to the drive start signal, the designation of all the scanning lines is set in the decoder 7. Also the designation of the scanning line L is set in the memory 8. The image information Ld is latched in the line memory 5. In the period T3, there is only conducted the writing of the scanning line L. There is no scanning line to be erased, as the decoder 7 sets, in the period T2, the non-selection signal which disables all the chip selections of the decoder 7. Also in said period T3, the next information is received from the graphic controller 11 and stored in the delay circuit 1. Then in a period T4, there is conducted the change in wave form or the frame drive. After said operation, the drive start signal is released to set the scanning line address information Ma in the decoder 7. In the memory 8 there is set the designation of non-selection for all the scanning lines. In a period T5, there is conducted preparation for re-starting the normal drive, and the scanning line M to be written after said re-start is erased, but the writing is prohibited. In a period T6 and thereafter, the normal drive with simultaneous erasure and writing is executed. FIG. 7 shows the driving wave form. In the following there will be explained the procedure when one-line partial re-writing is successively executed.

FIG. 8 is a timing chart of said procedure, There is shown a case in which the scanning line L is successively designated.

In the period T1 there is executed the normal drive, in which the scanning line address information La1 designating the scanning line L is detected. Then in response to the drive start signal, the scanning line address information La1 is set in the decoder 7, and the scanning line K, detected in the preceding period, is designated by the memory 8. In the period T2, the address detection circuit 3 detects the scanning line address information La2 designating the scanning line L the same as that detected in the period T1. In the normal drive, in response to the drive start signal, the scanning line address information La2 is set in the decoder 7, while the scanning line address information La1 is set in the memory 8, whereby the erasure and the writing are conducted simultaneously on a same line. Thus the normal drive cannot be conducted in this case. However, the microcomputer 31 stores the preceding address and compares it with the scanning line address information La2 detected in this period, and recognizes that the same scanning line has been designated twice in succession. In response to said recognition, the microcomputer 31 releases a non-selection signal, indicating the non-selection of all the scanning lines, instead of the scanning line address information La2, and said non-selection signal is set in the decoder 7 in response to the drive start signal. The scanning line address information La1 is set in the memory 8. In the period T3, there is only conducted the writing of the scanning line L, because of the function in the period T2. In the period T3, the microcomputer 31 prohibits the transfer of next information from the graphic controller 11, and supplies the scanning line address information La2, which is set in the decoder 7 in response to the drive start signal. The memory 8 stores the non-selection state for all the scanning lines. In the period T4, there is only conducted the erasure of the scanning line L. The next information is transferred in this period, so that the image information Ld2 is entered into the shift register 4. Also in response to the drive start signal, the image information Ld2 is set in the line memory 5 while the scanning line address information Ma is set in the decoder 7, and the memory 8 releases information designating the scanning line L. The normal drive is restored in the period T5. However, if the address is again La in the period T4, there is conducted, in the period T5, an operation the same as that in the period T3.

Figure 9:
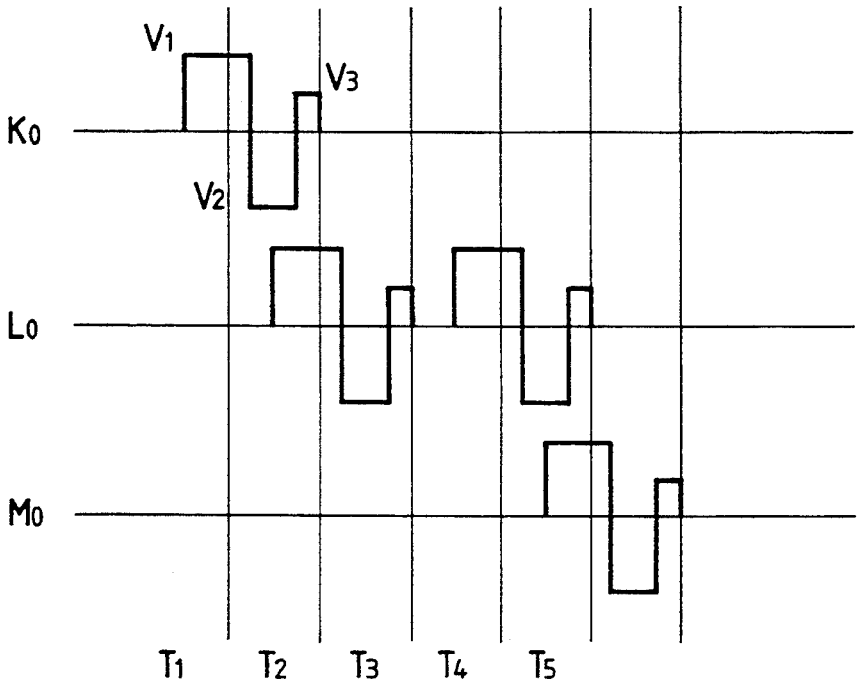
FIG. 9 is a wave form chart of the scanning signal in such state.

FIG. 9 shows the driving wave form.

FIGS. 11A to 11D show the scanning selection signal, and scanning non-selection signal, white and black information signals employed in the present invention. The sequence of the scanning selection signal is the same as shown in FIG. 5. The broken line portion of the information signal shown in FIG. 11C or 11D indicates a part of the preceding information signal.

In the present invention there may be employed a ferroelectric liquid crystal element disclosed, for example, in the U.S. Pat. No. 4,639,089 of Okada et al., U.S. Pat. No. 4,709,994 of Kanbe et al., or U.S. Pat. No. 4,712,873 of Kanbe et al.

As explained in the foregoing, there are provided a control device for prohibiting the input of the transferred information, a control circuit for enabling readout of the image information of at least a scanning line at an arbitrary time, and a circuit for selecting a non-selection state for all the addresses thereby interrupting the erasure of scanning line during the scanning period of a horizontal scanning line, whereby the scanning line to be selected next does not remain erased during the variation of the driving wave form or the frame drive. It is therefore rendered possible to prevent the presence of a black visible line, so that the correction of temperature characteristics, change of display mode or frame drive can be smoothly achieved in a display method in which at least two lines are simultaneously driven.

Also, there may be additionally provided a comparator for storing the preceding scanning line and comparing the same with the currently scanned line to achieve smooth drive in case one-line partial writing is required in succession, by switching from the erasure-writing simultaneous drive to the single-line drive.

Also in the present invention, since the erased scanning line is memorized, there can be smoothly conducted, for example, interlaced scanning.

What is claimed is:

1. A driving device, comprising:

matrix electrodes composed of scanning lines and information lines;

an information line driving circuit having a delay circuit for delaying the transfer of image information corresponding to writing into pixels of a scanning line, a serial-parallel converting circuit, and a first memory for storing the image information from said serial-parallel converting circuit;

a scanning line driving circuit having a scanning line designating circuit for generating scanning line information which designates a scanning line, and a second memory for storing the scanning line information generated by said scanning line designating circuit; and control means for controlling said information line driving circuit and said scanning line designating circuit so that the image information stored in said first memory which is used for Nth scanning, the scanning line information from said scanning line designating circuit which is used to designate a scanning line for (N+1)th scanning, and the scanning line information stored in said second memory which is used to designate a scanning line for Nth scanning are synchronously output, and said scanning line information used to designate the scanning line for (N+1)th scanning is output during outputting of the scanning line information for Nth scanning, and pixels on the scanning line designated by the scanning line information used to designate the scanning line for (N+1)th scanning are erased, and pixels on the scanning line designated by said scanning line information for designating Nth scanning stored in said second memory are written according to said image information stored in said first memory used for Nth scanning.

2. A driving device, comprising:

matrix electrodes composed of scanning lines and information lines;

an information line driving circuit having a delay circuit for delaying the transfer of image information corresponding to writing into pixels of a scanning line, a serial-parallel converting circuit, and a first memory for storing the image information from said serial-parallel converting circuit;

a scanning line driving circuit having a scanning line designating circuit for designating a scanning line, and a second memory for storing the scanning line information from said scanning line designating circuit; and control means for controlling said information line driving circuit and said scanning line driving circuit so that the image information stored in said first memory which is used for Nth scanning, the scanning line information from said scanning line designating circuit which is used to designate a scanning line for (N+1)th scanning, and the scanning line information stored in said second memory which is used to designate a scanning line for Nth scanning are synchronously output, and said scanning line information used to designate the scanning line for (N+1)th scanning is output during outputting of the scanning line information for Nth scanning, and pixels on the scanning line designated by the scanning line information used to designate the scanning line for (N+1)th scanning are erased, and pixels on the scanning line designated by the scanning line information for designating Nth scanning stored in said second memory are written according to said image information stored in said first memory used for Nth scanning and, further controlling said information line driving circuit and said scanning line driving circuit, when the number of designations of the scanning lines reaches a predetermined value, so as to prohibit the transfer of image information to said delay circuit, and during the application of the writing voltage signals to the pixels of the scanning line designated according to the information from said second memory, to apply a non-selection signal to the other scanning lines.

3. A driving device according to claim 2, wherein said control means comprises a counter for counting the number of designations of the scanning lines.

4. A driving device, comprising:

matrix electrodes composed of scanning lines and information lines;

an information line driving circuit having a delay circuit for delaying the transfer of image information corresponding to writing into pixels of a scanning line, a serial-parallel converting circuit, and a first memory for storing the image information from the serial-parallel converting circuit;

a scanning line driving circuit having a scanning line designating circuit for designating a scanning line, and a second memory for storing the designated scanning line information from said scanning line designating circuit; and a control circuit for controlling said information line driving circuit and said scanning line driving circuit so that the image information stored in said first memory which is used for Nth scanning, the scanning line information from said scanning line designating circuit which is used to designate a scanning line for (N+1)th scanning, and the scanning line information stored in said second memory which is used to designate a scanning line for Nth scanning are synchronously output, and said scanning line information used to designate the scanning line for (N+1)th scanning is output during outputting of the scanning line information for Nth scanning, and pixels on the scanning line designated by the scanning line information used to designate the scanning line for (N+1)th scanning are erased, and pixels on the scanning line designated by the scanning line information for designating Nth scanning stored in said second memory are written according to said image information stored in said first memory used for Nth scanning and further controlling said information line driving circuit and said scanning line driving circuit, in case the same scanning line is designated in succession, so as to prohibit the transfer of the image information to said delay circuit and, during the application of the writing voltage signals to the pixels of the scanning line designated according to the information from said second memory, to apply a non-selection signal to the other scanning lines.

5. A driving device according to claim 4, wherein said control means comprises means for comparing the content of the entered scanning line address information.

6. A driving device, comprising:

a liquid crystal cell comprising matrix electrodes composed of scanning lines and information lines and utilizing ferroelectric liquid crystal;

an information line driving circuit having a delay circuit for delaying the transfer of image information corresponding to the writing into pixels of a scanning line, a serial-parallel converting circuit, and a first memory for storing the image information from the serial-parallel converting circuit;

a scanning line driving circuit having a scanning line designating circuit for designating a scanning line, and a second memory for storing the designated scanning line information from said scanning line designating circuit; and control means for controlling said information line driving circuit and said scanning line driving circuit so that the image information stored in said first memory which is used for Nth scanning, the scanning line information from said scanning line designating circuit which is used to designate a scanning line for (N+1)th scanning, and the scanning line information stored in said second memory which is used to designate a scanning line for Nth scanning are synchronously output, and said scanning line information used to designate the scanning line for (N+1)th scanning is output during outputting of the scanning line information for Nth scanning, and pixels on the scanning line designated by the scanning line information used to designate the scanning line for (N+1)th scanning are erased, and pixels on the scanning line designated by the scanning line information for designating Nth scanning stored in said second memory are written according to said image information stored in said first memory used for Nth scanning.

7. A driving device, comprising:

a liquid crystal cell comprising matrix electrodes composed of scanning lines and information lines and utilizing ferroelectric liquid crystal;

an information line driving circuit having a delay circuit for delaying the transfer of image information corresponding to the writing into pixels of a scanning line, a serial-parallel converting circuit, and a first memory for storing the image information from said serial-parallel converting circuit;

a scanning line driving circuit having a scanning line designating circuit for designating a scanning line, and a second memory for storing the designated scanning line information from said scanning line designating circuit; and control means for controlling said information line driving circuit and said scanning line driving circuit so that the image information stored in said first memory which is used for Nth scanning, the scanning line information from said scanning line designating circuit which is used to designate a scanning line for (N+1)th scanning, and the scanning line information stored in said second memory which is used to designate a scanning line for Nth scanning are synchronously output, and the scanning line information used to designate the scanning line for (N+1)th scanning is output during outputting of the scanning line information for Nth scanning, and pixels on the scanning line designated by the scanning line information used to designate the scanning line for (N+1)th scanning are erased, and pixels on the scanning line designated by the scanning line information for designating Nth scanning stored in said second memory are written according to said image information stored in said first memory used for Nth scanning, and further controlling said information line driving circuit and said scanning line driving circuit, when the number of designations of scanning lines reaches a predetermined number, so as to prohibit the transfer of the image information to the delay circuit and, during the application of writing voltage signals to the pixels of the scanning line designated according to the information from said second memory, so as to apply a non-selection signal to the other scanning lines.

8. A driving device according to claim 7, wherein said control means comprises a counter for counting the number of designations of the scanning lines.

9. A driving device, comprising:

a liquid crystal cell comprising matrix electrodes composed of scanning lines and information lines and utilizing ferroelectric liquid crystals;

an information line driving circuit having a delay circuit for delaying the transfer of image information corresponding to the writing into pixels of a scanning line, a serial-parallel converting circuit, and a first memory for storing the image information from the serial-parallel converting circuit;

a scanning line driving circuit having a scanning line designating circuit for designating a scanning line, and a second memory for storing the designated scanning line information from said scanning line designating circuit; and control means for controlling said information line driving circuit and said scanning line driving circuit so that the image information stored in said first memory which is used for Nth scanning, the scanning line information from said scanning line designating circuit which is used to designate a scanning line for (N+1)th scanning, and the scanning line information stored in said second memory which is used to designate a scanning line for Nth scanning are synchronously output, and said scanning line information used to designate the scanning line for (N+1)th scanning is output during outputting of the scanning line information for Nth scanning, and pixels on the scanning line designated by the scanning line information used to designate the scanning line for (N+1)th scanning are erased, and pixels on the scanning line designated by the scanning line information for designating Nth scanning stored in said second memory are written according to said image information stored in said first memory used for Nth scanning, and further controlling said information line driving circuit and said scanning line driving circuit, in case the same scanning line is designated in succession, so as to prohibit the transfer of the image information to the delay circuit and, during the application of writing voltage signals to the pixels of the scanning line designated according to the information from said second memory, to apply a non-selection signal to the other scanning lines.

10. A driving device according to claim 9, wherein said control means comprises means for comparing the content of the entered scanning line address information.

11. A display system, comprising:

a display panel comprising matrix electrodes composed of scanning lines and information lines;

first means for transferring scanning line address information and image information corresponding to the writing into pixels of a scanning line;

second means for delaying the transfer of the received image information and then latching the image information of a scanning line; and third means for decoding (N+1)th scanning address information received, outputting the encoded (N+1)th scanning address information as an encoded (N+1)th address signal to a scanning signal generation circuit, applying a (N+1)th first scanning selection signal by which an erase operation of pixels on a scanning line is performed from the scanning signal generation circuit to the scanning line designated in response to said (N+1)th address signal, storing said decoded (N+1)th first signal in a memory, outputting to the scanning signal generation circuit an encoded Nth address signal corresponding to Nth received scanning address information previously stored in said memory, and applying an Nth second scanning selection signal by which a writing operation on a scanning line is performed from the scanning signal generation circuit to the scanning line designated in response to said Nth address signal, with the Nth second scanning selection signal being formed by a voltage wave different from the first scanning selection signal.

12. A display system according to claim 11, wherein said display panel has a memory effect.

13. A display system according to claim 11, wherein said display panel comprises ferroelectric liquid crystal.

14. A display system according to claim 11, further comprising means for overlapping said (N+1)th first scanning selection signal and said Nth second scanning selection signal so as to be outputted.

15. A display system according to claim 14, wherein said display panel has a memory effect.

16. A display system according to claim 14, wherein said display panel comprises ferroelectric liquid crystal.

17. A display system, comprising:

a display panel comprising matrix electrodes composed of scanning lines and information lines;

first means for transferring scanning line address information and image information corresponding to the writing into pixels of a scanning line;

second means for delaying the transfer of the received image information and then latching the image information of a scanning line;

third means for decoding (N+1)th scanning address information received, outputting the encoded (N+1)th scanning address information as an encoded (N+1)th address signal to a scanning signal generation circuit, applying a (N+1)th first scanning selection signal by which an erase operation of pixels on a scanning line is performed from the scanning signal generation circuit to the scanning line designated in response to said (N+1)th address signal, storing said decoded (N+1)th first signal in a memory, outputting to the scanning signal generation circuit an encoded Nth address signal corresponding to Nth received scanning address information previously stored in said memory, and applying an Nth second scanning selection signal by which a writing operation on a scanning line is performed from the scanning signal generation circuit to the scanning line designated in response to said Nth address signal, with the Nth second scanning selection signal being formed by a voltage wave from different from the first scanning selection signal; and fourth means for disenabling an address signal designating selection of a scanning line to which the first selection signal is applied when a designation number of the scanning line designated in accordance with said scanning address information reaches a predetermined number.

18. A display system according to claim 17, wherein said display panel has a memory effect.

19. A display system according to claim 17, wherein said display panel comprises ferroelectric liquid crystal.

20. A display system, comprising:

a display panel comprising matrix electrodes composed of scanning lines and information lines;

first means for transferring scanning line address information and image information corresponding to the writing into pixels of a scanning line;

second means for delaying the transfer of the received image information and then latching the image information of a scanning line;

third means for decoding (N+1)th scanning address information received, outputting the encoded (N+1)th scanning address information as an encoded (N+1)th address signal to a scanning signal generation circuit, applying a (N+1)th first scanning selection signal by which an erase operation of pixels on a scanning line is performed from the scanning signal generation circuit to the scanning line designated in response to said (N+1)th address signal, storing said decoded (N+1)th first signal in a memory, outputting to the scanning signal generation circuit an encoded Nth address signal corresponding to Nth received scanning address information previously stored in said memory, and applying an Nth second scanning selection signal by which a writing operation on a scanning line is performed from the scanning signal generation circuit to the scanning line designated in response to said Nth address signal, with the Nth second scanning selection signal being formed by a voltage wave from different from the first scanning selection signal; and fourth means for disenabling an address signal designating selection of a scanning line to which the first selection signal is applied when a designation number of the scanning line designated in accordance with said scanning address information reaches a predetermined number.

21. A display system according to claim 20, wherein said display panel has a memory effect.

22. A display system according to claim 20, wherein said display panel comprises ferroelectric liquid crystal.

23. A display system, comprising:

a display panel comprising matrix electrodes composed of scanning lines and information lines;

first means for transferring scanning line address information and image information corresponding to the writing into pixels of a scanning line;

second means for delaying the transfer of the received image information and then latching the image information of a scanning line;

third means for decoding (N+1)th scanning address information received, outputting the encoded (N+1)th scanning address information as an encoded (N+1)th address signal to a scanning signal generation circuit, applying a (N+1)th first scanning selection signal by which an erase operation of pixels on a scanning line is performed from the scanning signal generation circuit to the scanning line designated in response to said (N+1)th address signal, storing said decoded (N+1)th first signal in a memory, outputting to the scanning signal generation circuit an encoded Nth address signal corresponding to Nth received scanning address information previously stored in said memory, and applying an Nth second scanning selection signal by which a writing operation on a scanning line is performed from the scanning signal generation circuit to the scanning line designated in response to said nth address signal, with the Nth second scanning selection signal being formed by a voltage wave from different from the first scanning selection signal; and fourth means for controlling said second and third means so as to stop output of said first scanning selection signal and output a non-selection signal when designation of the scanning line designated in accordance with said scanning address information is generated so as to continuously designated the same scanning line.

24. A display system according to claim 23, wherein said display panel has a memory effect.

25. A display system according to claim 23, wherein said display panel comprises ferroelectric liquid crystal.

26. A display system, comprising:

a display panel comprising matrix electrodes composed of scanning lines and information lines;

first means for transferring scanning line address information and image information corresponding to the writing into pixels of a scanning line;

second means for delaying the transfer of the received image information and then latching the image information of a scanning line;

third means for decoding (N+1)th scanning address information received, outputting the encoded (N+1)th scanning address information as an encoded (N+1)th address signal to a scanning signal generation circuit, applying a (N+1)th first scanning selection signal by which an erase operation of pixels on a scanning line is performed from the scanning signal generation circuit to the scanning line designated in response to said (N+1)th address signal, storing said decoded (N+1)th first signal in a memory, outputting to the scanning signal generation circuit an encoded Nth address signal corresponding to Nth received scanning address information previously stored in said memory, and applying an Nth second scanning selection signal by which a writing operation on a scanning line is performed from the scanning signal generation circuit to the scanning line designated in response to said Nth address signal, with the Nth second scanning selection signal being formed by a voltage wave from different from the first scanning selection signal; and fourth means for disenabling an address signal designating selection of a scanning line to which the first selection signal is applied when a designation number of the scanning line designated in accordance with said scanning address information reaches a predetermined number.

27. A display system according to claim 26, wherein said display panel has a memory effect.

28. A display system according to claim 26, wherein said display panel comprises ferroelectric liquid crystal.

* * * * *

UNITED STATES PATENT AND TRADEMARK OFFICE

CERTIFICATE OF CORRECTION

PATENT NO. : 5,353,041

DATED : October 4, 1994

INVENTOR(S) : Miyamoto et al.

It is certified that error appears in the above-indentified patent and that said Letters Patent is hereby corrected as shown below:

COLUMN 1:

Line 18, "Arpliffe," should read --Ayliffe,--.

COLUMN 12:

Line 34, "from" (first occurrence) should be deleted.

COLUMN 13:

Line 7, "from" (first occurrence) should be deleted.
Line 48, "from" (first occurrence) should be deleted.

COLUMN 14:

Line 4, "designated" should read --designate--.
Line 39, "from" (first occurrence) should be deleted.

Signed and Sealed this

Ninth Day of May, 1995

Bruce Lehman

*Attest:*

BRUCE LEHMAN

*Attesting Officer*

*Commissioner of Patents and Trademarks*